US005391091A

United States Patent [19]

Nations

[11] Patent Number: 5,391,091

[45] Date of Patent: Feb. 21, 1995

[54] CONNECTION SYSTEM FOR BLIND MATE ELECTRICAL CONNECTOR APPLICATIONS

[75] Inventor: Alvin R. Nations, Simi Valley, Calif.

[73] Assignee: American Nucleonics Corporation, Westlake Village, Calif.

[21] Appl. No.: 85,564

[22] Filed: Jun. 30, 1993

[51] Int. Cl.[6] ..... H01R 13/645

[52] U.S. Cl. ..... 439/378; 439/359

[58] Field of Search ..... 439/297, 298, 378-381, 439/681, 359, 362, 364

[56] References Cited

U.S. PATENT DOCUMENTS

| | | | |
|---|---|---|---|
| 3,951,500 | 4/1976 | Anderson | 439/248 |
| 4,179,178 | 12/1979 | Bachman et al. | 439/378 X |
| 4,998,892 | 3/1991 | Shiley | 439/378 X |

OTHER PUBLICATIONS

ITT Cannon catalog, *Military/Aerospace Connector Sourcebook 1993-1994*, pp. 381-382, 1993.

*Primary Examiner*—Eugene F. Desmond

*Attorney, Agent, or Firm*—Hoffmann & Baron

[57] ABSTRACT

A connection system particularly suited for blind mate applications wherein a male connector is to be coupled to a female receptacle which cannot be aligned for mating using normal visual alignment and insertion techniques including at least two guide pins secured to either the connector or receptacle and mating sockets each having an axial bore dimensioned for receiving a guide pin secured to the other component. The guide pins and sockets are positioned so that when the guide pins are inserted into the sockets, the connector aligns with the receptacle for simple connection. The guide pins and sockets are secured to the connector and receptacle such that the length and width confines of the connector and receptacle are not increased by the guide pins and sockets. Furthermore, the guide pins provide mechanical support for the connection and the sockets include a flange for spacing the electrical receptacle a predetermined distance above a surface to which the receptacle is mounted.

16 Claims, 4 Drawing Sheets

CONNECTION SYSTEM FOR BLIND MATE ELECTRICAL CONNECTOR APPLICATIONS

BACKGROUND OF THE INVENTION

1. Field Of The Invention

The present invention relates to a connection system for blind mate electrical connector applications, and, more particularly, relates to a guide pin and socket system for use in blind mate connections.

2. Description Of The Prior Art

In building electronic devices, there is frequently a need to plug an electro-mechanical device into a mating electrical receptacle which may be recessed such that normal visual alignment and insertion techniques cannot be used. Previous alignment techniques include separate guide pins positioned on the electro-mechanical device and a mating socket recess positioned on the mating electrical receptacle for receiving the guide pins.

Known guide pins and mating sockets are separate components and are not part of the electrical connector plug and receptacle. Accordingly, special housings may be necessary, and, at the very least, more space is needed to accommodate the connector and guide pin system than just the connector alone. This type of arrangement presents a major disadvantage in designs having a minimum of space available. In this age of miniaturization, working space within the electronic device is most often at a premium. Furthermore, situations arise in which a separate guide pin and socket arrangement cannot be used due to lack of space thereby making a blind mate connection extremely difficult, if not impossible. This often times occurs with convention subminiature D-type connectors.

Another disadvantage of known blind mate coupling systems utilizing separate guide pins and mating sockets is that the pieces must be assembled. The guide pins have to be attached to the connector and the mating sockets have to be coupled in some way to the receptacle. In some cases, additional components such as a connector and receptacle hood to house the guide pins and mating sockets must be used. This type of arrangement adds more components requiring assembly and adds unnecessary and, oftentimes, undesirable weight to the device. Thus, there may be situations where known guide pin and mating socket systems cannot be used since there is not enough space to add separate guide pins and mating sockets to the arrangement. Alternatively, the weight of the device may be crucial to the design and thus eliminate the possibility of extra components being added to the assembly.

OBJECTS AND SUMMARY OF THE INVENTION

It is an object of the present invention to provide a connection system for a blind mate application which does not increase the overall length and/or width of the electrical plug and receptacle.

It is another object of the present invention to provide a connection system for a blind mate application requiring little or no assembly or additional components.

It is yet another object of the present invention to provide a connection system for a blind mate application which provides mechanical support to the connection.

It is yet a further object of the present invention to provide a connection system for a blind mate application which does not appreciably increase the weight of the connectors.

It is another object of the present invention to provide a connection system for a blind mate application which spaces the electrical receptacle the proper distance above a surface of a printed circuit board or the like to which the receptacle is mounted.

In accordance with one form of the present invention, a connection system for aligning an electrical connector with a mating electrical receptacle preferably includes two guide pins secured to either the electrical connector or the mating electrical receptacle. In the preferred embodiment, the guide means are secured to the connector. The system further preferably includes two guide pin sockets having an axial bore therein dimensioned for receiving the guide pins. The sockets are secured to the other of the electrical connector and mating electrical receptacle and preferably the receptacle, such that when the guide pins are received by the sockets, the connector is aligned with and easily coupled to the mating electrical receptacle.

The guide pins include a distal end having a tapered section thereon terminating substantially in a point. The tapered guide pin aids in aligning the guide pin with the mating socket. Furthermore, the guide pin is of sufficient length to provide mechanical support to the connection of the electrical connector to the mating receptacle. A proximal end of the guide pin includes a threaded section for securing the guide pins to a mounting plate of the electrical connector. The mounting plate includes openings through the thickness thereof dimensioned for receiving the threaded section of the guide pins. The guide pins are secured by means of a nut threadably secured to the proximal end of the guide pins.

The electrical receptacle also includes a mounting plate having openings through the thickness thereof and dimensioned for receiving and securing a proximal end of the guide pin socket therein. The guide pin socket is press fitted into the mounting plate opening. The guide pin socket further includes means for spacing the electrical receptacle a predetermined distance above a surface to which the receptacle is mounted. In the preferred embodiment, the spacing means is a flange positioned on an exterior surface of the guide pin socket. The flange prevents further insertion of the distal end of the socket through the mounting plate openings.

The connection system as previously defined is well suited for situations involving minimal space and miniaturized components. For example, the connection system is particularly well suited for use with a D-type subminiature connector.

In a preferred embodiment, the receptacle is mounted on a printed circuit board. The printed circuit board includes openings through the thickness thereof dimensioned for receiving the digital end of a guide pin socket. The receptacle is secured to the printed circuit board using any known securing means, and preferably the distal end of the guide pin socket is threaded and secured to the printed circuit board by threadably securing a nut thereto. The guide pin socket provides mechanical support for mounting the receptacle to the printed circuit board.

Furthermore, the guide pin socket preferably includes an enlarged bore section at the proximal end thereof to aid in receiving the distal end of the mating guide pin. The enlarged bore section terminates in a tapered section providing a transitional region to the axial bore of the guide pin socket. The combination of the enlarged bore at the proximal end of the guide pin socket and the tapered distal end of the guide pin allows for an initial slight misalignment which is automatically aligned as the guide pin is further inserted into the bore of the guide pin socket. Thus, the connector and receptacle are thereby aligned and can be easily coupled.

The connection system in accordance with the present invention also provides mechanical support to the connection between the connector and receptacle. The mechanical support alleviates the stress on the connector pins which are received by the receptacle. The connector pins normally provide the support for such a connection.

The connection system of the present invention is designed so that the length and width confines of the connector and receptacle are maintained even with the guide pins and sockets attached. This feature of the connection system becomes important in applications where space within a device is at a premium.

A preferred form of the connectors using the connection system of the present invention, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Referring to FIGS. 1–5, a blind mate connection system formed in accordance with the present invention generally includes a male connector 2 and a female receptacle 4. The male connector 2 includes at least one, and preferably two guide pins 6 coupled thereto. The female receptacle 4 includes mating sockets 8 integrally formed into the receptacle 4, the sockets 8 being adapted for receiving the guide pins 6.

Figure 1:
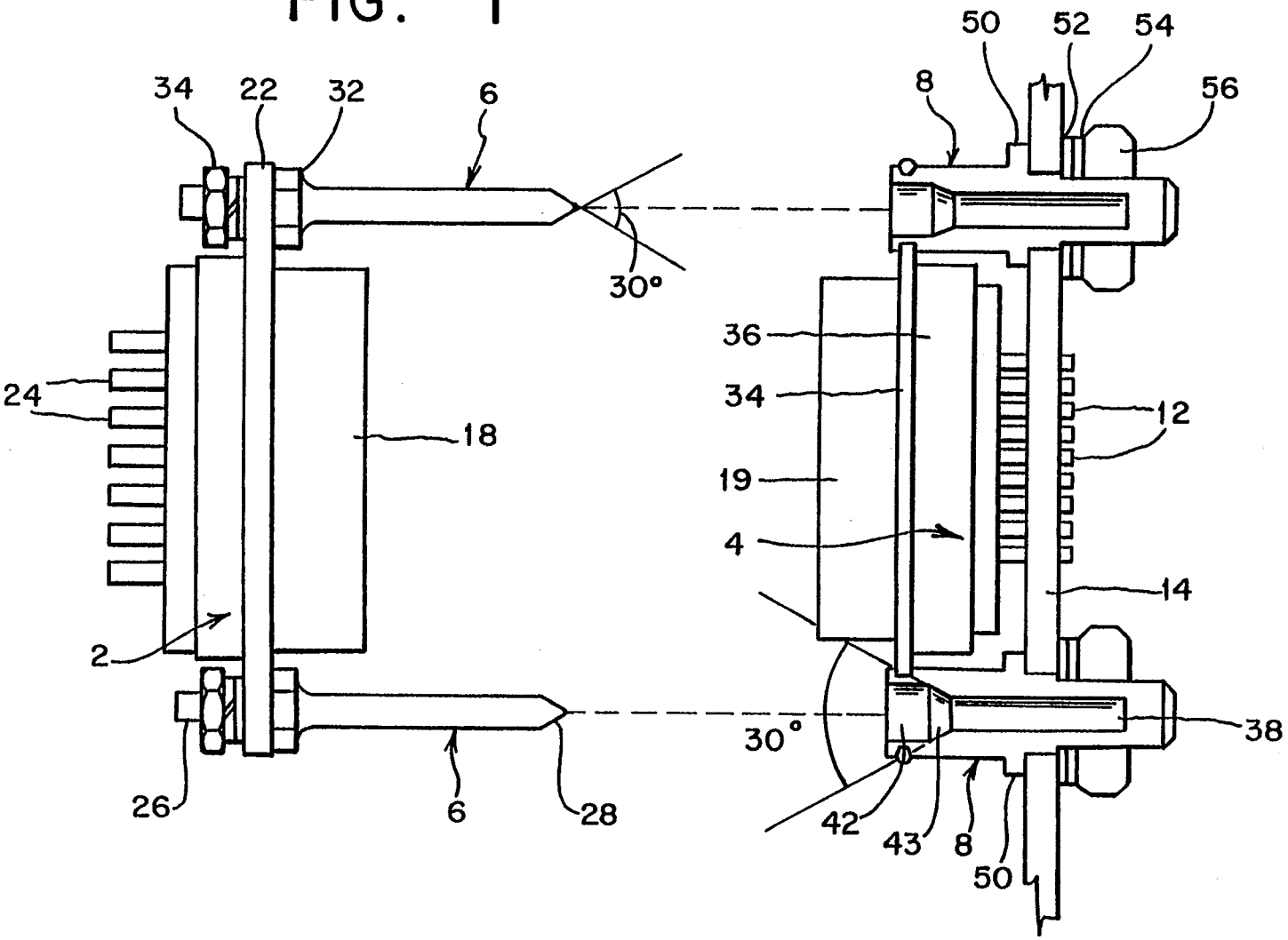
FIG. 1 is a top elevational view of an electrical connector having a connection system of the present invention shown in a disconnected position.

A preferred embodiment of the present invention as illustrated in FIG. 1 is a blind mate connection system for a D-type subminiature electrical connector. The D-type subminiature electrical connector is used extensively in the commercial, military and aerospace industries. Oftentimes, the receptacle 4 of the D subminiature electrical connector is electrically connected via pins 12 extending from a back portion of the receptacle 4 to a printed circuit board 14.

Figure 2:
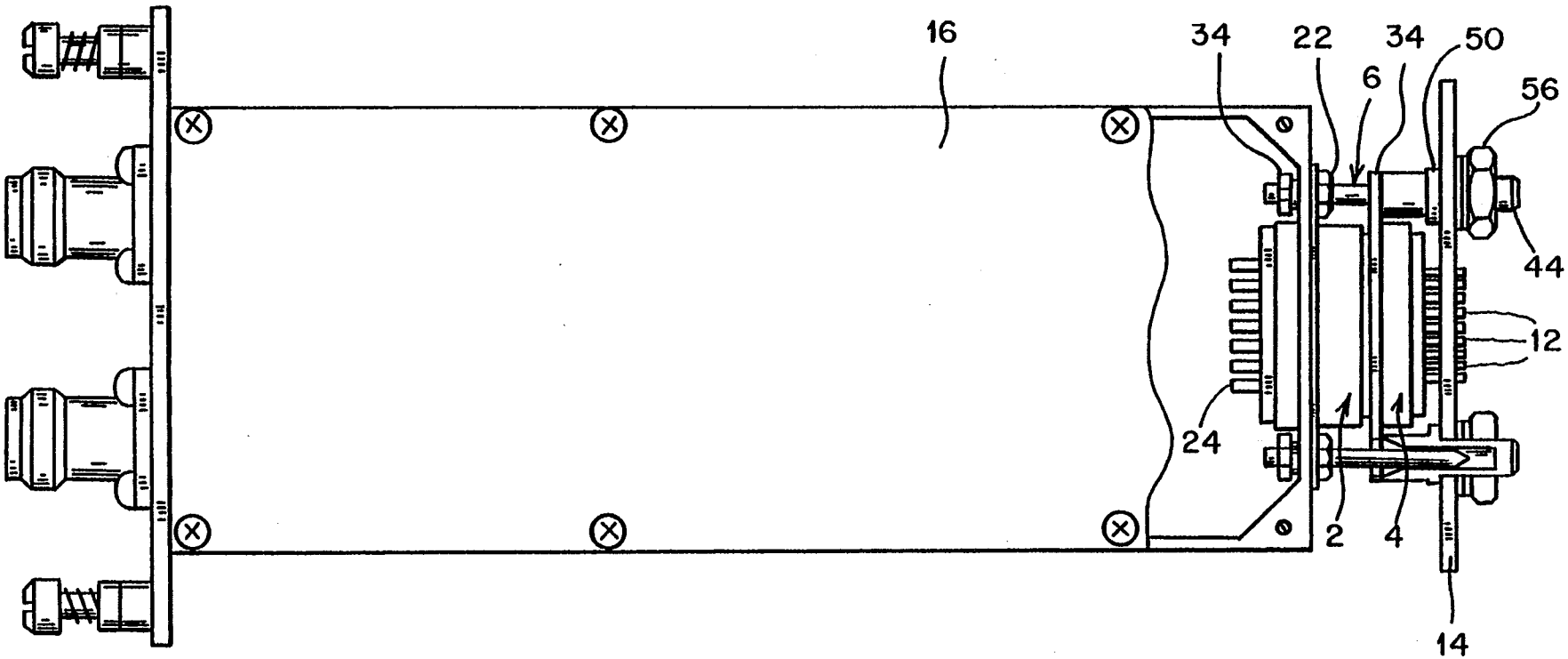
FIG. 2 is a partial cutaway top elevational view of an electric module connected to an electrical receptacle utilizing the connection system of the present invention.

Referring to FIG. 2, a blind mate application often arises in building electronic equipment such that an electronic module 16 having a male D subminiature connector 2 is to be connected to a receptacle 4 mounted on a printed circuit board 14. The electronic module 16 is usually larger than the male connector 2 and the receptacle 4 may be positioned so that visual alignment of the connector is impossible. In these instances, an integrally formed blind mate connection system in accordance with the present invention provides a convenient method of connection. Furthermore, the integrally formed blind mate connection system does not add to the exterior dimensions of either the male connector or female receptacle. Accordingly, if no extra space is available, the connection system of the present invention can still be utilized.

Figure 3:
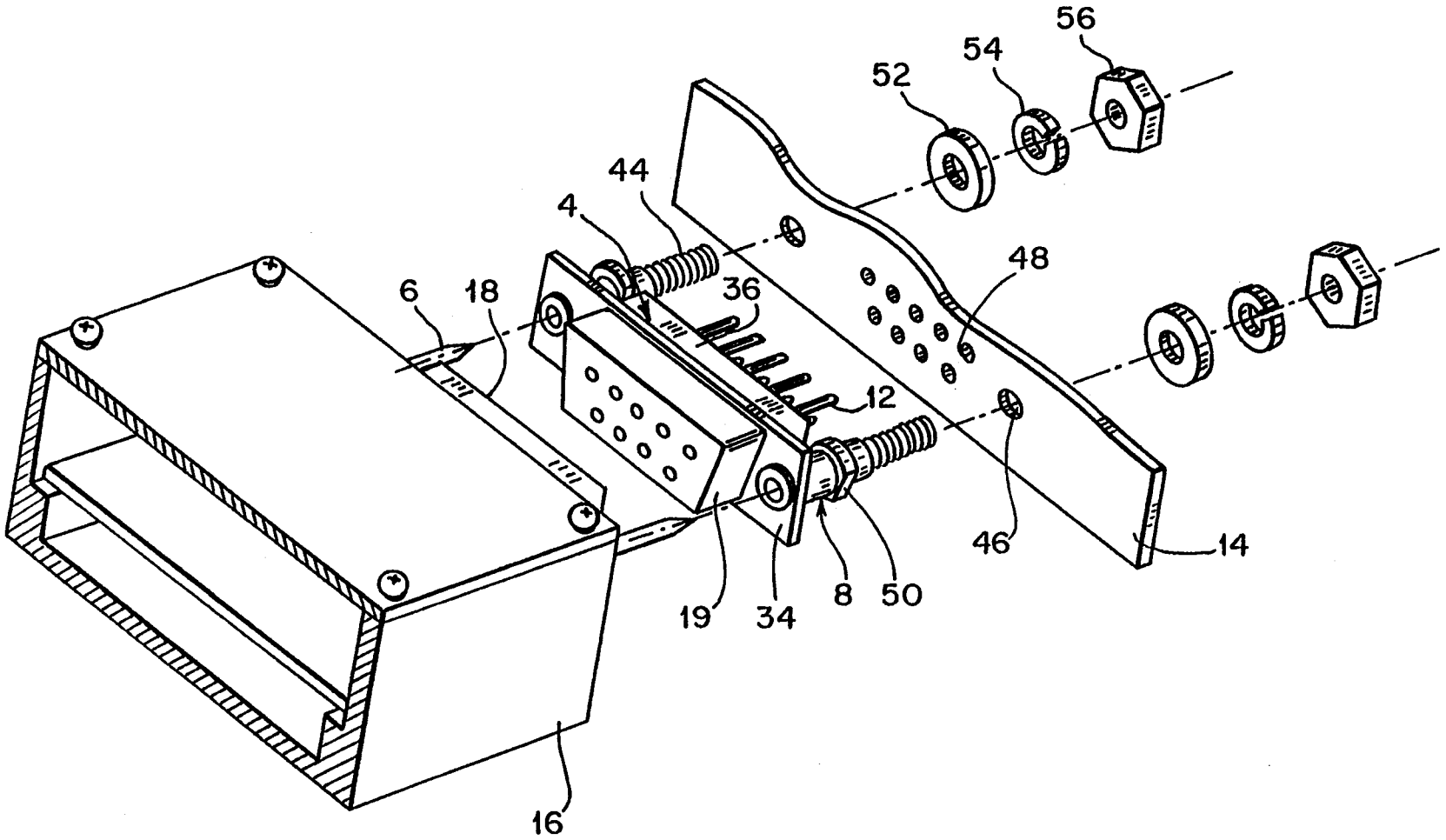
FIG. 3 is an exploded side perspective view of the assembly shown in FIG. 2.

Referring to FIGS. 1 and 3, the male D subminiature electrical connector generally includes connection pins (not shown) positioned within a substantially trapezoidally shaped housing 18. Since the housing 18 covering the connection pins and the mating housing on the receptacle 19 are substantially in the shape of a trapezoid, the connector is prevented from being connected to the receptacle incorrectly, i.e., upside down. The male connector 2 also includes a mounting plate 22 having two openings formed through the thickness thereof at opposite sides of the connector. The male D subminiature connector also includes a coupling means, i.e., connecting pins 24, for electrically coupling the connector to an electronic device either directly or through the use of ribbon wire (not shown) having a mating connector thereon.

The guide pins 6 formed in accordance with the preferred embodiment of the present invention include a threaded section 26 at a proximal end and a taper to a rounded point 28 at a distal end. The threaded section 26 of the guide pin is dimensioned to be positioned within the opening formed in the mounting plate 22 of the male connector. The guide pin 6 also includes an outwardly extending flange 32 situated on an exterior surface of the pin, which abuts the mounting plate 22 of the connector when the guide pin is positioned within the openings of the mounting plate and which provides further support for the guide pin when the pin is mounted on plate 22. The guide pins 6 are secured to the mounting plate 22 by a nut 34 and the flange 32. In the preferred embodiment, a flat washer and a lock washer are positioned onto the threaded portion of the guide pin before the nut 34 is fastened thereto. The threaded section of the guide pin also provides the mechanism by which the male connector is secured to a device such as an electronic module as illustrated in FIG. 2.

Referring to FIG. 1, the guide pins 6 are tapered at the distal end to aid in alignment of the male connector with the female receptacle. In the preferred embodiment, the taper is designed such that two lines drawn extending from opposite sides of the tapered point form approximately a 30° angle. As previously mentioned, the tapered point is preferably rounded thereby reducing the possibility of damaging other components within the device should the guide pins contact them during placement within the device. The tapered point of the guide pin 6 along with an enlarged opening in the guide pin socket 8 permit a slight initial misalignment which automatically aligns as the guide pin 6 is inserted further into the socket 8. Accordingly, in a blind mate application, there is room for a slight initial misalignment when coupling the connector 2 to the receptacle 4.

Referring to FIGS. 1 and 3, the female receptacle 4 also includes a mounting plate 34 positioned between the trapezoidal front portion 19 of the receptacle and a rear portion 36. The receptacle mounting plate 34 formed in accordance with the preferred embodiment of the present invention includes openings through the thickness thereof dimensioned for receiving a proximal end of the guide pin socket. The openings in the mounting plate 34 are positioned on opposite sides of the trapezoidal portion of the receptacle 19. The sockets 8 are preferably press-fitted into the openings of the receptacle mounting plate 34 during manufacture. The guide pins 6 on the male connector are positioned to be in alignment with an axial bore 38 of the socket positioned on the female receptacle, thus aligning the connector with the receptacle 4.

The axial bore 38 of the socket is dimensioned for receiving the mating guide pin 6. A proximal or receiving end of the guide pin socket includes an enlarged bore section 42 to assist in aligning and mating the guide pin 6 with the socket bore 38. The enlarged bore section 42 at the proximal end of the socket includes a tapered section 43 providing a transitional region from the enlarged bore 42 to the smaller dimensioned axial bore 38 of the socket. Referring to FIG. 1, the tapered section 43 is dimensioned so that two lines extending outwardly on opposite sides of the bore along the taper form approximate a 30° angle. This angle corresponds to the angle formed by the taper at the distal end of the guide pin 6. The corresponding angles permit ease of insertion when the guide pin 6 and socket bore are initially slightly misaligned.

A distal end of the guide pin socket includes a threaded section 44. The receptacle 4 including the press-fitted guide pin sockets 8 are shown in FIG. 3 in an exploded view to illustrate the manner in which the receptacle formed in accordance with the present invention is connected to a printed circuit board 14 or the like. The threaded section 44 of the sockets is passed through holes 46 drilled in the printed circuit board 14. The printed circuit board also includes smaller holes 48 dimensioned for receiving the pins 12 of the receptacle. Generally, the pins are soldered to a bottom surface of the printed circuit board thereby making electrical connection therewith.

The guide pin sockets 8 formed in accordance with the preferred embodiment of the present invention include an outwardly extending flange 50 positioned a predetermined distance from the mounting plate 34 on an exterior surface of the socket. The flange 50 provides a means for spacing the electrical receptacle the proper distance above the printed circuit board or the like. Thus, the flange 50 provides a shoulder so that the receptacle 4 is maintained a specified distance above the printed circuit board 14. Depending upon the specific connector and application, the guide pin socket 8 can be made to have a flange 50 which maintains the receptacle the required distance above the printed circuit board 14 or the like. The receptacle is connected to the printed circuit board 14 by placing a flat washer 52 and lock washer 54 onto the threaded section which has been passed through the holes 46 in the printed circuit board and thereafter threadably securing a nut 56 onto the distal end of the guide pin socket 8.

The securing of the sockets 8 to the printed circuit board 14 and the use of flange 50 abutting against the surface of the printed circuit board provide mechanical support for the receptacle 4. The mechanical support of the sockets 8 reduces the stress which would normally be placed upon the pins 12 which are merely soldered to the printed circuit board 14. The pins 12 are generally rather fragile and can easily bend. Thus, they do not provide adequate mechanical support for mounting the 35 receptacle 4 to the printed circuit board 14. Furthermore, repeated connections and disconnections or undesired movement of the receptacle can break the solder points electrically coupling the receptacle pins 12 to the printed circuit board, thus causing the device to fail.

Figure 4:
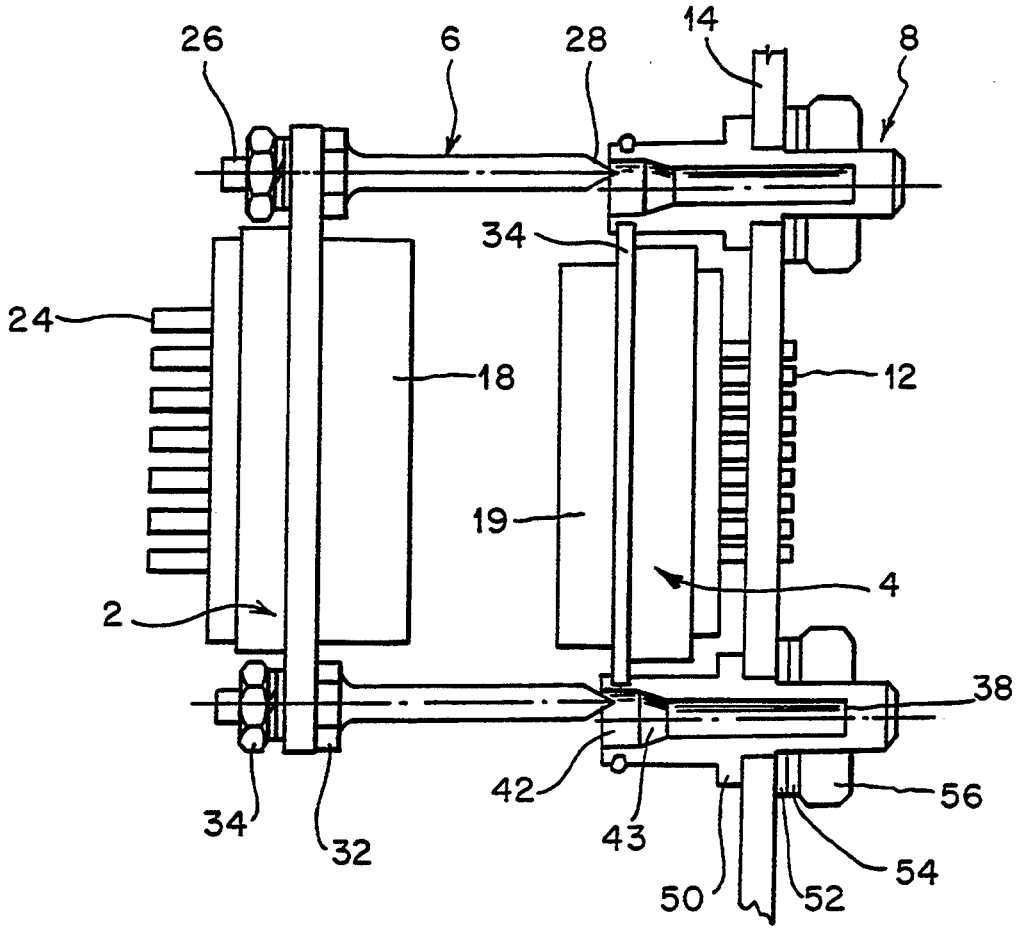
FIG. 4 is a top elevational view of an electrical connector having the connection system of the present invention illustrating the alignment characteristics thereof.

Referring to FIG. 4, the alignment function of the blind mate connection system of the present invention is readily apparent. In FIG. 4, the guide pins 6 are illustrated in a position slightly misaligned with the axial bore 38 of the receptacle socket. The tapered distal end 28 of the guide pins facilitates mating the guide pins 6 with the sockets 8 such that when the tapered end 28 is positioned within the enlarged bore section 42 at the proximal end of the socket, the guide pin will be self-aligned as it is inserted further into the small diameter axial socket bore 38. The tapered transitional section 43 of the socket bore also places the connector 2 in alignment with the receptacle 4. Thus, by inserting the guide pins 6 into their mating sockets 8, the connector and receptacle are automatically aligned for coupling. By correctly aligning the connector 2 with the receptacle, the blind mate connection is confidently and properly completed.

A completed connection using the blind mate connection system of the present invention is illustrated in FIG. 2. Referring to the cut-away view of the bottom guide pin socket 8 shown in FIG. 2, it is illustrated that the guide pins 6 extend beyond the printed circuit board 14. Thus, the guide pins 6 positioned within the axial bore 38 of the sockets provide mechanical support for the connection system. As is readily apparent from FIG. 2, when an electronic module 16 requires connection to a printed circuit board 14, it is beneficial to have a means for mechanically supporting the connection made therebetween. Without the mechanical support of the blind mate connection system formed in accordance with the present invention, the connection between the electronic module 16 and printed circuit board 14 would be supported solely by the pins of the connector and possibly the connector pin housing 18 and receptacle housing 19. The pins of the connector could easily bend or decouple from the receptacle possibly causing failure of the device.

Generally, conventional connectors such as the D-type subminiature electrical connectors do not provide adequate support to maintain proper connection. In many instances, additional bulky support means must be incorporated with the connector. The present blind mate connection system offers a convenient, space-saving alignment and support system for electro-mechanical connectors and especially the D subminiature electrical connector.

Figure 5:
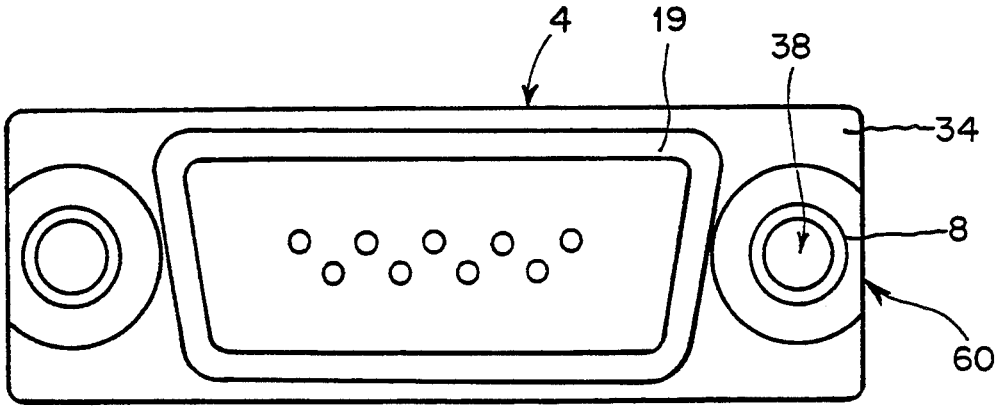
FIG. 5 is a front elevational view of an electrical receptacle of the present invention.

As previously mentioned, in a field such as electronics where miniaturization is usually a concern, the blind mate connection system of the present invention provides several advantages. For miniaturization purposes, the connection system of the present invention provides a compact means for aligning and mating electrical connectors. Referring to FIG. 2, it will be appreciated by those skilled in the art that the guide pins and mating sockets are maintained substantially within the length and width confines of the connector and receptacle, respectively. As illustrated in FIG. 5, the socket fitted into the mounting plate 34 of the receptacle may include a cutaway surface 60 to maintain the connection system within the length and width confines of the receptacle. In this manner, when space is at a minimum or not available for extra components, the connection system of the present invention may be utilized.

The blind mate connection system of the present invention clearly provides several advantages over known connection systems which require assembly of multiple components and can significantly increase the physical size of the connector in order to perform the necessary functions. The connection system of the present invention provides a system of integrally formed components which have been preassembled thereby reducing the overall number of components during assembly of a device. The connection system also adds minimal weight to an assembly by reducing the number of additional components to a minimum.

The connection system formed in accordance with the present invention also provides mechanical support for coupling both the male connector and female receptacle to electronic components, i.e., an electronic module and printed circuit board, respectively. In addition, the socket performs multiple functions: it receives and aligns the mating guide pin; it is used for mounting the receptacle portion of the connection assembly to a printed circuit board or other structure; and it provides a means for properly spacing the receptacle a desired distance above the printed circuit board. The connection system of the present invention also includes the advantage of providing mechanical support to the connection, or, as shown in FIG. 2, the connection of an electronic module to a printed circuit board. Thus, the stress on the connector itself is alleviated. Yet another advantage of the present invention is that it is compact and does not extend beyond the length and width confines of the electrical connector and receptacle.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connection system, which comprises:
an electrical connector which includes integral means for mounting said connector;
an electrical receptacle mateable with the electrical connector and which includes integral means for mounting said receptacle;
at least one guide pin having a proximal end secured to the integral mounting means for one of the electrical connector and mating electrical receptacle; and 2. An electrical connection system as defined by claim 1, wherein said integral mounting means of said electrical connector includes a mounting plate having an opening formed through the thickness thereof and dimensioned for receiving the proximal end of said guide pin, and the proximal end of the guide pin having means for securing said guide pin to said mounting plate.

3. An electrical connection system as defined by claim 2, wherein said securing means includes a threaded section on said proximal end of said guide pin and a nut threadably secured thereon.

4. An electrical connection system as defined by claim 1, wherein said guide pin includes a distal end having a tapered section thereon terminating substantially in a point.

5. An electrical connection system as defined by claim 1, wherein said integral mounting means of said electrical receptacle includes a mounting plate having an opening formed through the thickness thereof and dimensioned for receiving and securing a proximal end of said guide pin socket therein.

6. An electrical connection system as defined by claim 5, wherein said socket further includes means for spacing the electrical receptacle a predetermined distance above a surface to which the receptacle is mounted.

7. An electrical connection system as defined by claim 6, wherein said spacing means comprises an outwardly extending flange positioned on an exterior surface of said socket.

8. An electrical connection system as defined by claim 1, wherein said socket interiorly defines an enlarged bore section at the proximal end thereof, a uniform diameter axial bore and a tapered section interposed between the enlarged bore and the uniform diameter axial bore and providing a transitional region to said uniform diameter axial bore, the enlarged bore section providing an increased reception area for said guide pin for ease of coupling.

9. An electrical connection system as defined by claim 1, wherein the socket further includes means for mounting the receptacle to a supporting structure.

10. An electrical connection system as defined by claim 9, wherein the receptacle mounting means includes a threaded portion on the socket and a nut threadably secured thereon.

11. An electrical connection system as defined by claim 1, wherein said guide pin is of sufficient length to provide mechanical support to the connection of said electrical connector to said mating receptacle.

12. An electrical connection system which comprises:
an electrical connector including a mounting plate having openings formed through the thickness thereof;
an electrical receptacle mateable with said electrical connector, the receptacle including a mounting plate having openings formed through the thickness thereof;
at least two guide pins secured to said connector mounting plate, each of said guide pins having a proximal end and a distal end, said openings in the mounting plate dimensioned for receiving the proximal end of each of said guide pins, the proximal end of each of said guide pins including means for securing said guide pins to said mounting plate, the distal end of each of said guide pins having a tapered section thereon terminating substantially in a point, each of said guide pins being of sufficient length to provide mechanical support to said connection system;
at least two guide pin sockets having an axial bore therein dimensioned for receiving each of said guide pins, each of said guide pin sockets having a proximal end and a distal end, the proximal end of each of said sockets being secured within said receptacle mounting plate openings, the distal end of each of said sockets having means for mounting the receptacle to a supporting structure and means for spacing the electrical receptacle a predetermined distance from the supporting structure, such that when each of said guide pins are received by each of said sockets, said electrical connector is aligned with and easily coupled to said mating electrical receptacle and wherein said guide pins and sockets are maintained within a length and width confine of said electrical connector and mating receptacle; and wherein said electrical connector and receptacle is a D-type subminiature connector assembly.

at least one guide pin socket having an axial bore therein dimensioned for receiving said guide pin, said socket being secured to the other integral mounting means of said electrical connector and mating electrical receptacle such that when said guide pin is received by said socket, said electrical connector is aligned with and easily coupled to said mating electrical receptacle and wherein said integral mounting means of said connector and receptacle for securing said guide pin and socket maintains the connection system within a length and width confine of said electrical connector and mating receptacle, and wherein said electrical connector and receptacle is a D-type subminiature connector assembly.

13. An electrical connection system as defined by claim 12, wherein said securing means includes a threaded section on said proximal end of each of said guide pins and a nut threadably secured thereon.

14. An electrical connection system as defined by claim 12, wherein said spacing means comprises an outwardly extending flange positioned on an exterior surface of each of said sockets.

15. An electrical connection system as defined by claim 12, wherein each of said sockets interiorly defines an enlarged bore section at the proximal end thereof, a uniform diameter axial bore and a tapered section interposed between the enlarged bore and the uniform diameter axial bore and providing a transitional region to said uniform diameter axial bore, the enlarged bore section providing an increased reception area for each of said guide pins for ease of coupling.

16. An electrical connection system as defined by claim 12, wherein the receptacle mounting means includes a threaded portion on each of said sockets and a nut threadably secured thereon.

* * * * *

UNITED STATES PATENT AND TRADEMARK OFFICE

CERTIFICATE OF CORRECTION

PATENT NO. : 5,391,091

DATED : February 21, 1995

INVENTOR(S) : Alvin R. Nations

It is certified that error appears in the above-indentified patent and that said Letters Patent is hereby corrected as shown below:

Column 1, line 36, now reads "convention" and should read --conventional--;

Column 2, line 15, now reads "means" and should read --pins--;

Column 5, line 25, now reads "approximate" and should read --approximately--;

Column 6, line 4, now reads "35 receptacle 4" and should read --receptacle 4--;

Column 7, Claim 1, line 54 now reads "and" and should read --and at least one guide pin socket having an axial bore therein dimensioned for receiving said guide pin, said socket being secured to the other integral mounting means of said electrical connector and mating electrical receptacle such that when said guide pin is received by said socket, said electrical connector is aligned with and easily coupled to said mating electrical receptacle and wherein said integral mounting means of said connector and receptacle for securing said guide pin and socket maintains the connection system within a length and width confine of said electrical connector and mating receptacle, and wherein said electrical connector and receptacle is a

UNITED STATES PATENT AND TRADEMARK OFFICE

CERTIFICATE OF CORRECTION

PATENT NO. : 5,291,091

DATED : February 21, 1995

INVENTOR(S) : Alvin R. Nations

It is certified that error appears in the above-indentified patent and that said Letters Patent is hereby corrected as shown below:

D-type subminiature connector assembly.--.

Signed and Sealed this

Thirteenth Day of June, 1995

*Attest:*

Bruce Lehman

BRUCE LEHMAN

*Attesting Officer*

*Commissioner of Patents and Trademarks*